United States Patent [19]

Maggio et al.

[11] Patent Number: 4,635,308

[45] Date of Patent: Jan. 13, 1987

[54] METHOD OF USING A BED SHEET STAY

[76] Inventors: Charles F. Maggio, 472 N. Country Rd., St. James, N.Y. 11780; Angelina M. Spombiantti, 3 Jayne Ave., Huntington Station, N.Y. 11746

[21] Appl. No.: 751,897

[22] Filed: Jul. 5, 1985

[51] Int. Cl.[4] ..... A44B 21/00

[52] U.S. Cl. ..... 5/508; 24/72.5

[58] Field of Search ..... 5/496, 498, 508; 24/72.5

[56] References Cited

U.S. PATENT DOCUMENTS

| | | | |
|---|---|---|---|
| 2,931,055 | 4/1960 | Sostrin | 5/496 |
| 3,962,757 | 6/1976 | Gedney | 24/72.5 |
| 4,400,836 | 8/1983 | Pelura | 24/72.5 |
| 4,520,518 | 6/1985 | Reaser | 5/496 |

FOREIGN PATENT DOCUMENTS

| | | | |
|---|---|---|---|
| 202300 | 8/1958 | Austria | 5/498 |
| 2228156 | 12/1973 | Fed. Rep. of Germany | 24/72.5 |

*Primary Examiner*—Alexander Grosz

*Attorney, Agent, or Firm*—Leonard Belkin

[57] ABSTRACT

A bed sheet stay consisting of a flat, elongated member having an opening at one end and a slotted opening to receive the gathered corner of a sheet. The other end of the member is provided with rearwardly and outwardly extending fins to prevent tipping of the stay in use. A pinched waist permits hugging of the stay by the bedding to prevent sliding of the stay. The invention involves also a method of securing the corner of a sheet using such a stay.

2 Claims, 5 Drawing Figures

METHOD OF USING A BED SHEET STAY

BACKGROUND OF THE INVENTION

This invention relates to a bed sheet stay and more particularly to a bedsheet stay employed to hold in place the corner of a sheet tucked between a mattress and a box spring.

Due to recent changes in the depths of mattresses many fitted sheets are too small for the beds with the result that many persons are returning to the use of flat sheets. But the disadvantages of flat sheets, which the fitted sheets were designed to overcome, are now faced once again by the consumer. Such problems are the sheets become pulled loose during use, wrinkled bedding surfaces, and complete resetting of the sheets after each use.

SUMMARY OF THE PRESENT INVENTION

The present invention makes it possible to obtain all of the benefits of the fitted sheet in the flat sheet, and at a cost substantially less than that of a fitted sheet.

In a preferred embodiment of this invention there is provided a bed sheet stay which comprises a flat member having an elongated configuration, a generally circular opening through the member adjacent one end thereof, and a slotted opening through the member spaced from the circular opening.

The gathered corner of the sheet is drawn through the circular opening until the sheet on the mattress is tightened to the satisfaction of the user of the stay and then through the slotted opening. The stay is then slipped under the mattress where it is held in place by the mattress pressing against the support or box spring.

The member additionally is shaped to form a pinched waist which resist sliding movement of the stay so that it tends to remain where placed. The stay additionally incorprates a pair of wing extensions or fins to resist lifting of the sides or the end of the stay where the circular opening is located in order to prevent slippage of the sheet through the openings.

In another preferred embodiment of this invention there is provided a method of securing a corner of a bed sheet in place under a mattress comprising the steps of pulling the corner of the sheet through the generally circular opening adjacent one end of a flat, elongated member, the member having a slot therethrough spaced from the circular opening, a pinched waist, and a pair of spread wing extensions or fins at the other end of said member, passing the corner of the sheet through said slot, pulling the sheet taut on said member, and placing said member under said mattress. The mattress pressing against the member on the box spring along the pinched waist prevents sliding movement of the member and the fins prevent lifting up of either side or the first end of the member thereby resisting loosening of the sheet passing through the openings.

It is thus a principal object of this invention to provide a bed sheet stay for holding the corner of a flat sheet in place on a mattress.

Another object of this invention is a method for holding the corners of a flat sheet in place on a mattress.

Other objects and advantages of this invention will hereinafter become obvious from the following description of preferred embodiments of this invention.

DETAILED DESCRIPTION OF THE PREFERRED EMBODIMENTS

Figure 1:
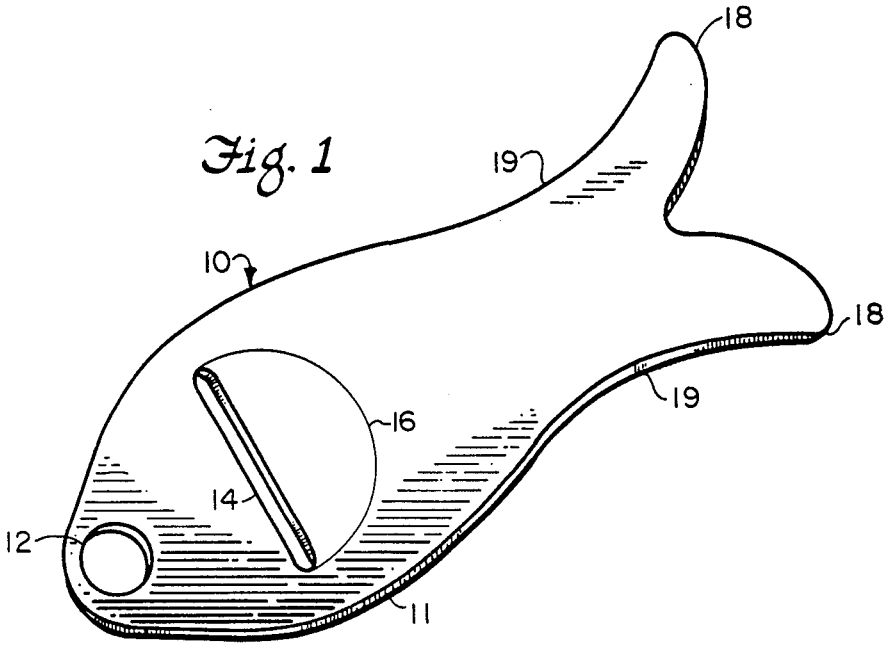
FIG. 1 is an isometric view of a stay incorporating the principles of this invention.

Referring to FIG. 1, stay 10 is a flat, elongated member 11 of suitable material such as a plastic, for example, polypropylene. Member 11 may be rigid with some flexibility to permit slight bending. At one end of member 11 is an opening 12 of generally circular configuration and could be oval or any other suitable shape large enough to pull through the gathered corner of a bed sheet. Opening 12 should be large enough to accommodate the gathered corner of a sheet. It has been found that for a circular opening a diameter of at least one inch is required.

Spaced from opening 12 is a slotted opening 14 disposed generally transverse to the length of member 11. A tab or tag 16 of flexible material such as paper or cloth may be cemented to member 11 and lapped or folded through slotted opening 14 to provide a roughened surface to insure additional resistance to sliding of the sheet. This is especially useful where the sheet is of sheer material such as silk.

The other end of stay 10 is provided with a pair of extended wings or fins 18 which are directed rearwardly and spread outwardly. The purpose of fins 18 is to inhibit tipping of stay 10 either sideways or along its principal axis. It will be noted that member 11 has a pinched waist 19 whose purpose will be described later.

Figure 2:
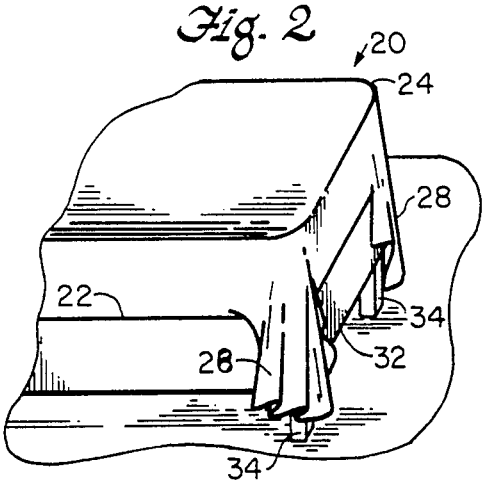
FIG. 2 is an isometric view of the foot of a bed formed by a mattress on a box spring.
Figure 3:
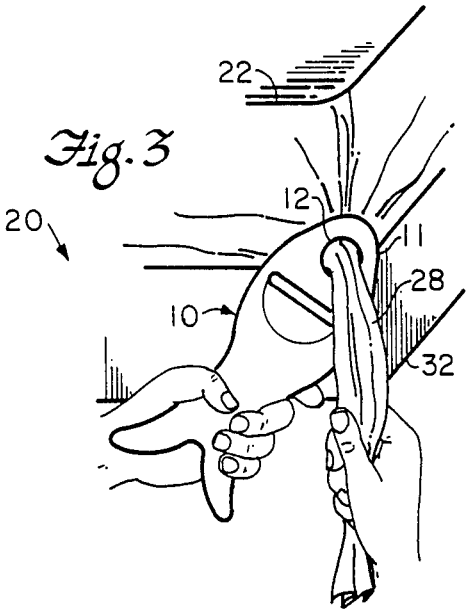
FIG. 3 shows how the cover of the bed sheet is pulled through the circular opening in the bed stay.
Figure 4:
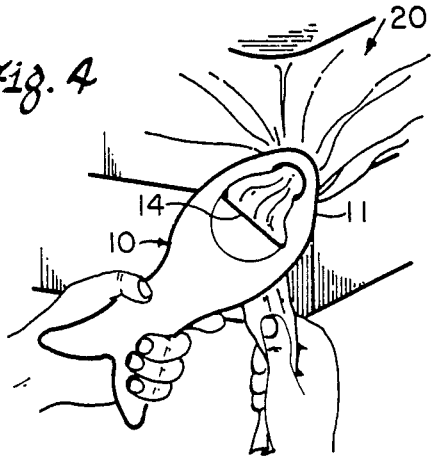
FIG. 4 shows how the corner of the bed sheet is pulled through the slotted opening.
Figure 5:
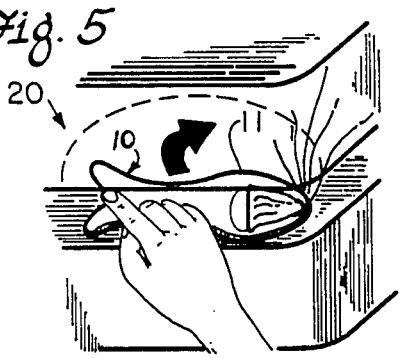
FIG. 5 shows the stay being put in place under the mattress.

For a description of the use of stay 10 reference is made to FIGS. 2–4. Bed 20 consists of a mattress 22 having a sheet 24 with gathered corners 28 at the foot of bed 20 mounted on a box spring 32 supported by legs 34.

A gathered corner 28 of sheet 24 is pulled through opening 12 in stay 10 until the sheet on the upper surface of mattress 22 is at the desired smoothness. Then gathered corner 28 is pulled through slotted opening 14 and the loose part of gathered end 28 is placed up against the side of stay 10 which is then slipped under and placed as shown by the arrow under mattress 22 where the weight of the latter presses stay 10 against box spring 32. For the bottom sheet of bed 20 all four corners of the sheet are secured in this way. For the top sheet, the two corners at the foot of the bed may be thus secured.

Pinched waist 19 helps to reduce the risk of sliding movement of stay 10. When the latter is in place the bedding is crimped down or hugged along waist 19 which resists the tendency of any such movement. Also, as seen in FIGS. 3 and 4, waist 19 makes it easier for the user to grasp stay 10. As previously mentioned, fins 18 prevent tipping of stay 10.

It is thus seen that there has been provided a device of simple and economical construction capable of securing flat sheets on a mattress to a degree which has heretofore been difficult or impossible without going to more expensive measures as well as a method for securing the covers of a flat sheet.

While only certain preferred embodiments of this invention have been described it is understood that many variations are possible without departing from the principles of this invention as defined in the claims which follow.

What is claimed:

1. The method of holding the corner of a bed sheet in place under a mattress comprising the steps of gathering the corner of said sheet, pulling the gathered corner of said sheet through the generally circular opening in a flat, elongated member, said member having a slot therethrough spaced from said circular opening, a pinched waist, and a pair of rearwardly and outwardly projecting fins forming a part of and extending from said pinched waist at the other end of said stay, passing said gathered corner of the sheet through said slot and pulling the sheet taut on said stay, and slipping said stay uder said mattress so that the bedding pressing against said mattress adjacent said waist prevents sliding movement of said stay, and said fins resisting tipping of said stay.

2. The method of claim 1 in which said stay includes means passing through said slot to resist sliding of said sheet when said stay is in use.

* * * * *